US011576553B2

(12) United States Patent
Eisenbart et al.

(10) Patent No.: US 11,576,553 B2
(45) Date of Patent: Feb. 14, 2023

(54) DISH-RECEIVING UNIT AND DOMESTIC DISHWASHER

(71) Applicant: BSH Hausgeräte GmbH, Munich (DE)

(72) Inventors: Bernd Eisenbart, Holzheim (DE); Lukas Kuhn, Munich (DE); Michael Lugert, Jettingen-Scheppach (DE); Werner Oblinger, Mödingen (DE)

(73) Assignee: BSH Hausgeräte GmbH, Munich (DE)

( * ) Notice: Subject to any disclaimer, the term of this patent is extended or adjusted under 35 U.S.C. 154(b) by 120 days.

(21) Appl. No.: 17/047,412

(22) PCT Filed: Apr. 23, 2019

(86) PCT No.: PCT/EP2019/060376
§ 371 (c)(1),
(2) Date: Oct. 14, 2020

(87) PCT Pub. No.: WO2019/206914
PCT Pub. Date: Oct. 31, 2019

(65) Prior Publication Data

US 2021/0113055 A1 Apr. 22, 2021

(30) Foreign Application Priority Data

Apr. 26, 2018 (DE) ..... 10 2018 206 447.4

(51) Int. Cl.
*A47L 15/50* (2006.01)
*A47L 15/42* (2006.01)
*A47L 15/16* (2006.01)

(52) U.S. Cl.
CPC ..... *A47L 15/50* (2013.01); *A47L 15/4289* (2013.01); *A47L 15/16* (2013.01)

(58) Field of Classification Search
None
See application file for complete search history.

(56) References Cited

U.S. PATENT DOCUMENTS

| | | | | |
|---|---|---|---|---|
| 9,596,976 | B2 * | 3/2017 | McDaniel | A47L 15/508 |
| 2007/0006903 | A1 | 1/2007 | Koch et al. | |
| 2009/0159103 | A1 | 6/2009 | Bertsch et al. | |
| 2015/0257623 | A1 | 9/2015 | Beshears, Jr. et al. | |

FOREIGN PATENT DOCUMENTS

| | | | |
|---|---|---|---|
| DE | 19847151 | A1 | 4/2000 |
| DE | 19960311 | A1 | 6/2001 |

OTHER PUBLICATIONS

Scott Telin, What's the difference between linear and rotary in a control valve?, Oct. 20, 2015, Crane Engineering, pp. 1-3 (Year: 2015).*
National Search Report DE 102018206447.4 dated Feb. 18, 2019.
International Search Report PCT/EP2019/060376 dated Jun. 24, 2019.

* cited by examiner

*Primary Examiner* — Rita P Adhlakha
(74) *Attorney, Agent, or Firm* — Michael E. Tschupp; Andre Pallapies; Brandon G. Braun

(57) ABSTRACT

A dish-receiving unit for a household dishwasher includes a lattice-like base, an intensive washing zone, and a manually operable on/off valve configured to switch the intensive washing zone optionally from a deactivated state to an activated state and vice versa, said on/off valve being operable through the base.

25 Claims, 18 Drawing Sheets

DISH-RECEIVING UNIT AND DOMESTIC DISHWASHER

CROSS-REFERENCES TO RELATED APPLICATIONS

This application is the U.S. National Stage of International Application No. PCT/EP2019/060376, filed Apr. 23, 2019, which designated the United States and has been published as International Publication No. WO 2019/215521 A1 and which claims the priority of German Patent Application, Serial No. 10 2018 206 447.4 filed Apr. 26, 2018, pursuant to 35 U.S.C. 119(a)-(d).

BACKGROUND OF THE INVENTION

The present invention relates to a dish-receiving unit, in particular dish rack, for a household dishwasher, and a household dishwasher having at least one such dish-receiving unit.

A dishwasher has a dishwasher cavity and dish-receiving units arranged in the dishwasher cavity for receiving items to be washed. The items to be washed may be supplied with washing liquor and/or fresh water for the cleaning thereof, for example by means of a rotatably mounted spray arm. Moreover, so-called intensive washing zones may be provided, said intensive washing zones being able to be switched on in order to clean, for example, items to be washed which are particularly heavily soiled.

EP 1 708 608 B1 discloses a dish rack for a dishwasher having a supply pipe for a spray arm which is rotatably mounted below the dish rack, wherein a branch pipe is arranged in the region of the supply pipe for an intensive washing zone which is provided in the region of the dish rack and which consists of rod-shaped guiding elements which are provided with outlet nozzles and wherein the guiding elements are fastened to the bars of the dish rack.

U.S. Pat. No. 9,596,976 B2 discloses a dish rack having an intensive washing zone which is able to be switched on, wherein a valve for switching on the intensive washing zone is provided inside the dish rack.

BRIEF SUMMARY OF THE INVENTION

Against this background, an object of the present invention is to provide an improved dish-receiving unit for a household dishwasher.

Accordingly, a dish-receiving unit, in particular a dish rack, for a household dishwasher is proposed. The dish-receiving unit has a lattice-like base, an intensive washing zone provided on the dish-receiving unit, and a manually operable on/off valve which is designed to switch the intensive washing zone optionally from a deactivated state to an activated state and vice versa, wherein the on/off valve is operable through the base.

The on/off valve is advantageously clearly visible for a user since the on/off valve is attached below the dish-receiving unit. It is possible to control the on/off valve easily with just one finger or with several fingers. Due to its attachment below the base of the dish-receiving unit, the on/off valve is well protected from damage by items to be washed. Even in the case of a fully loaded dish-receiving unit, a subsequent control of the on/off valve is possible from below or from the side. The on/off valve may be embodied using a separate additional component which may be already premounted on an inlet pipe of the dish-receiving unit. In particular, a complex additional mounting of switching parts, switching rods, electronic switching valves or the like is not required on the dish-receiving unit. Only small flow losses are produced, since the on/off valve is preferably integrated directly in the water supply of the intensive washing zone. Advantageously this results in a very small spray shadow by a spray arm provided on the dish-receiving unit, due to a very small installation space of the on/off valve.

An "on/off valve" in the present case is preferably to be understood as a valve which may be switched from an open position in which the on/off valve is fully open into a closed position in which the on/off valve is fully closed and vice versa. In other words, preferably intermediate positions or intermediate states between the open position and the closed position are not possible in the case of the on/off valve or at least the on/off valve does not automatically remain in such an intermediate state. In other words, the user is able to hold the on/off valve in an intermediate position by applying a force or a torque. As soon as the force or the torque no longer acts on the on/off valve, said on/off valve is automatically switched either into the open position or into the closed position. The on/off valve may also be denoted as a switching valve. The on/off valve has, in particular, two switching states, namely the open position and the closed position.

By the on/off valve being "manually operable", it is to be understood that for operating the on/off valve preferably an actuating element, such as for example a solenoid valve or an electric motor, or the like is not required. The on/off valve is directly operated manually by a user. Preferably, the on/off valve is operated with just one finger or with two fingers.

The dish-receiving unit may be an upper basket, a lower basket or a cutlery drawer of the household dishwasher. The dish-receiving unit preferably comprises a front wall, a rear wall arranged parallel to the front wall, two opposing side walls and the base. The front wall, the rear wall, the side walls and the base are lattice-like. In particular, the dish-receiving unit is constructed from a plurality of interconnected curved wires.

By means of the on/off valve, the intensive washing zone may be switched from its deactivated state, in which the intensive washing zone is not supplied with washing liquor and/or fresh water, into the activated state, in which the intensive washing zone is supplied with washing liquor and/or fresh water, and vice versa. A plurality of intensive washing zones may be provided on the dish-receiving unit. Accordingly, a plurality of on/off valves may also be provided. A plurality of on/off valves may also be assigned to an intensive washing zone. Moreover, a plurality of intensive washing zones may also be assigned to an on/off valve. The aforementioned inlet pipe may also be provided on the dish-receiving unit, the spray arm being rotatably mounted on said inlet pipe. Preferably, the on/off valve is arranged between the inlet pipe and the intensive washing zone. In this case, the on/off valve is preferably designed optionally to connect the intensive washing zone fluidically to the inlet pipe and to disconnect it again therefrom.

According to an embodiment, the on/off valve has an open position and a closed position, wherein the on/off valve is spring-biased both in the direction of the open position and in the direction of the closed position.

As a result, it may be achieved that when the on/off valve is switched from the open position into the closed position, the on/off valve automatically snaps either into the open position or into the closed position. As a result, intermediate positions between the open position and the closed position may be reliably avoided. This results in high quality haptic characteristics of the on/off valve, due to the on/off valve being snapped both into the open position and into the closed position. As soon as the on/off valve is located either in the open position or in the closed position, in particular, spring-biasing is no longer present. In other words, in each case a spring-biasing is only present in the intermediate positions between the open position and the closed position so that the on/off valve is not able to remain in these intermediate positions but is automatically switched either into the open position or into the closed position.

According to a further embodiment the on/off valve is a cross sliding valve.

A "cross sliding valve" in the present case is to be understood as a valve with a valve housing and a valve body which is displaceable in a linear manner in the valve housing. For switching the on/off valve from the open position into the closed position and vice versa, the valve body is preferably moved perpendicular to a through-flow direction of the on/off valve in which washing liquor and/or fresh water flows. In contrast thereto, a "rotary valve" comprises a valve body rotatably received in a valve housing.

According to a further embodiment, the on/off valve has a valve housing and a valve body which is received in the valve housing and which is displaceable in a linear manner in the valve housing for switching the on/off valve from the open position into the closed position and vice versa.

Preferably, the valve body comprises a preferably cylindrical base portion which is received in the valve housing. A through-flow opening is provided in the base portion, washing liquor and/or fresh water flowing through said through-flow opening when the on/off valve is in the open position. In the closed position, the cylindrical valve body covers the through-flow openings provided in the valve housing. Preferably, both in the open position and in the closed position the valve body is positively latched to the valve housing. A positive connection is produced by the interlocking or rear-engagement of at least two connecting partners, in this case the valve body and the valve housing.

According to a further embodiment, the valve body has a spring portion which spring-biases the valve body both in the direction of the open position and in the direction of the closed position.

The spring portion is preferably L-shaped and extends from a front side of the base portion of the valve body. The base portion and the spring portion are preferably configured in a single piece, in particular from a single material. Preferably, the valve body is a plastic injection-molded component. As soon as the on/off valve is either in the open position or in the closed position, as mentioned above, spring-biasing is no longer present. In other words, the spring portion is relaxed both in the open position and in the closed position.

According to a further embodiment, the spring portion has a guiding surface which, when the on/off valve is switched from the open position into the closed position and vice versa, slides on a corresponding mating surface of the valve housing until an apex point of the mating surface is reached, wherein the spring portion automatically switches the on/off valve into the closed position or into the open position when the apex point is passed.

In other words, when the on/off valve is switched from the open position into the closed position, as long as the corresponding guiding surface of the spring portion has not yet passed the apex point, the on/off valve is automatically reset into the open position. As soon as the apex point is passed, the on/off valve is automatically set into the closed position.

According to a further embodiment, the spring portion has a first guiding surface and a second guiding surface which are inclined relative to one another.

The first guiding surface and the second guiding surface may be inclined to one another, for example, at an angle of 90°. The first guiding surface and the second guiding surface may transition into one another in a rounded portion.

According to a further embodiment, the valve housing has a first mating surface and a second mating surface which are inclined relative to one another, wherein the first mating surface transitions into the second mating surface at the apex point.

Preferably, the first mating surface of the valve housing is assigned to the second guiding surface of the spring portion, and the second mating surface of the valve housing is assigned to the first guiding surface of the spring portion. The first mating surface may transition into the second mating surface in a rounded portion.

According to a further embodiment, the spring portion has a stop which in the open position bears against a corresponding abutment of the valve housing.

As a result, both a travel limit in the direction of the open position is implemented and a captive securing of the valve body is ensured.

According to a further embodiment, in the closed position the stop engages in a recess of the mating surface.

As a result, it is ensured that the stop does not slide on the first mating surface of the valve housing and impair the function of the spring portion. Moreover, a travel limit is also implemented in the direction of the closed position.

According to a further embodiment the on/off valve is a rotary valve.

As mentioned above, in contrast to a cross sliding valve, a rotary valve comprises a valve body rotatably mounted in a valve housing. Preferably, by rotating a valve body by 90° the on/off valve may be switched from the open position into the closed position and vice versa.

According to a further embodiment, the on/off valve has a valve housing and a valve body which is received in the valve housing and which is rotatable in the valve housing for switching the on/off valve from the open position into the closed position and vice versa.

Preferably, the valve body comprises a tubular base portion which is received in the valve housing. The base portion comprises two through-flow openings which correspond to two through-flow openings of the valve housing. In the open position the through-flow openings of the base portion are congruent with the through-flow openings of the valve housing and in the closed position the base portion of the valve body covers the through-flow openings provided in the valve housing.

According to a further embodiment, the valve housing has spring portions which spring-bias the valve body both in the direction of the open position and in the direction of the closed position.

The spring portions are preferably configured as resiliently deformable spring arms which are elastically deformed outwardly away from the valve body when the valve body is rotated in the valve housing. As soon as the on/off valve is either in the open position or in the closed position, in particular, spring-biasing is no longer present. In other words, the spring portions are relaxed both in the open position and in the closed position.

According to a further embodiment, the valve body has a square contour which is designed to deform the spring portions in a resilient manner when the on/off valve is switched from the open position into the closed position and vice versa.

The square contour cooperates, in particular, with the spring portions such that when the on/off valve is in an intermediate position between the open position and the closed position, it is switched either automatically into the open position or automatically into the closed position. As a result, undesired intermediate positions between the open position and the closed position are prevented. This results in excellent haptic characteristics of the on/off valve during the control thereof.

Moreover, a household dishwasher having at least one such dish-receiving unit is proposed.

The household dishwasher may comprise a plurality of such dish-receiving units. The dish-receiving units are arranged in a dishwasher cavity of the household dishwasher and may be displaced out of and into said dishwasher cavity.

Further possible implementations of the dish-receiving unit and/or the household dishwasher also comprise combinations of features or embodiments which are described above or below relative to the exemplary embodiments and which are not explicitly mentioned. In this case, the person skilled in the art will also add individual features as improvements or additions to the respective basic form of the dish-receiving unit and/or the household dishwasher.

BRIEF DESCRIPTION OF THE DRAWINGS

Further advantageous embodiments and features of the dish-receiving unit and/or the household dishwasher form the subject matter of the subclaims and the exemplary embodiments of the dish-receiving unit and/or the household dishwasher described hereinafter. Moreover, the dish-receiving unit and/or the household dishwasher are described in more detail by means of preferred embodiments with reference to the accompanying figures.

DETAILED DESCRIPTION OF EXEMPLARY EMBODIMENTS OF THE PRESENT INVENTION

Figure 1:
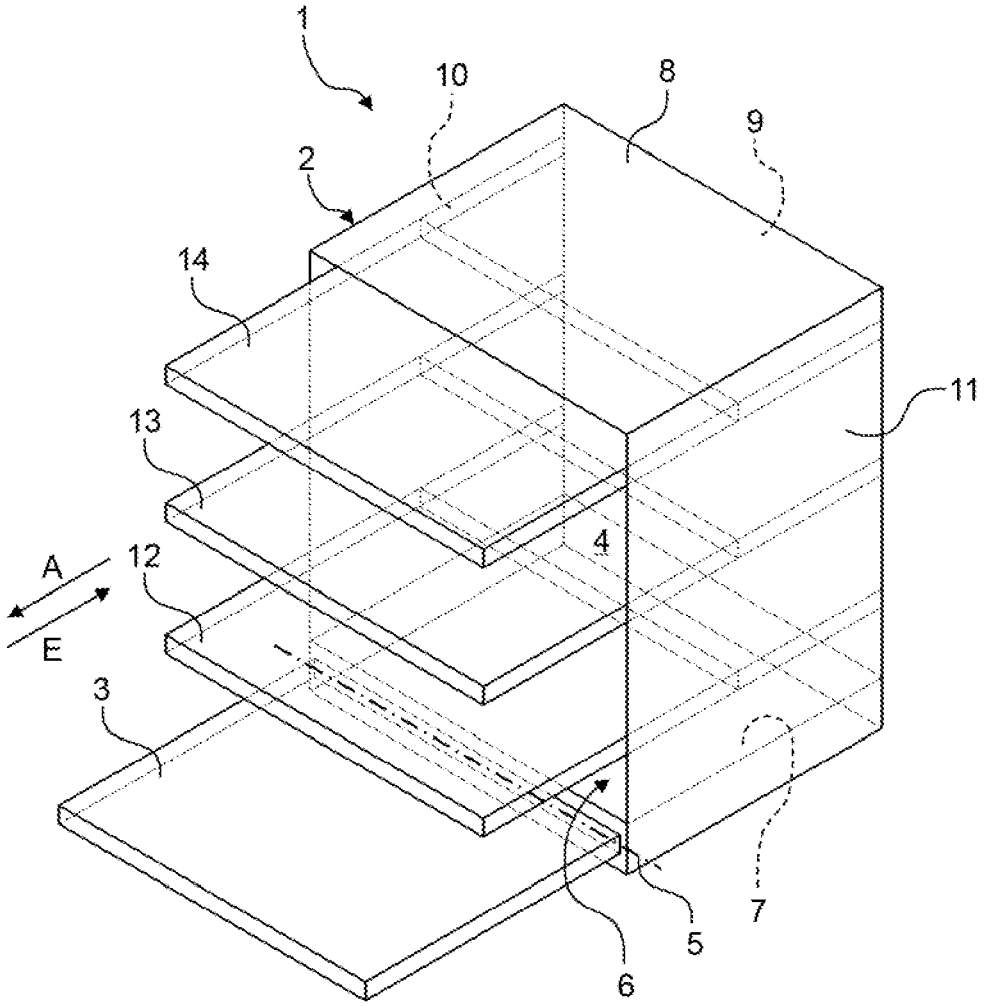
FIG. 1 shows a schematic perspective view of an embodiment of a household dishwasher.

Elements which are identical or functionally identical have been provided in the figures with the same reference numerals, unless indicated otherwise.

FIG. 1 shows a schematic perspective view of an embodiment of a household dishwasher 1. The household dishwasher 1 comprises a dishwasher cavity 2 which is closable by a door 3, in particular in a watertight manner. To this end, a sealing device may be provided between the door 3 and the dishwasher cavity 2. The dishwasher cavity 2 is preferably cuboidal. The dishwasher cavity 2 may be arranged in a housing of the household dishwasher 1. The dishwasher cavity 2 and the door 3 may form a dishwasher interior 4 for washing items to be washed.

The door 3 is shown in FIG. 1 in its open position. The door 3 may be closed or opened by pivoting about a pivot axis 5 provided on a lower end of the door 3. A loading opening 6 of the dishwasher cavity 2 may be closed or opened by means of the door 3. The dishwasher cavity 2 has a base 7, a ceiling 8 arranged opposite the base 7, a rear wall 9 arranged opposite the closed door 3, and two opposingly arranged side walls 10, 11. The base 7, the ceiling 8, the rear wall 9 and the side walls 10, 11 may be manufactured, for example, from a stainless steel sheet. Alternatively, for example, the base 7 may be manufactured from a plastic material.

The household dishwasher 1 also has at least one dish-receiving unit 12 to 14. Preferably, a plurality of dish-receiving units 12 to 14, for example three thereof, may be provided, wherein the dish-receiving unit 12 may be a lower dish-receiving unit or a lower basket, the dish-receiving unit 13 may be an upper dish-receiving unit or an upper basket and the dish-receiving unit 14 may be a cutlery drawer. The dish-receiving units 12 to 14 may also be denoted as dish racks. As FIG. 1 further shows, the dish-receiving units 12 to 14 are arranged on top of one another in the dishwasher cavity 2. Each dish-receiving unit 12 to 14 is optionally displaceable into or out of the dishwasher cavity 2. In particular, each dish-receiving unit 12 to 14 may be pushed in or inserted in an insertion direction E into the dishwasher cavity 2 and pulled out or extended out of the dishwasher cavity 2 counter to the insertion direction E in a pull-out direction A.

Figure 2:
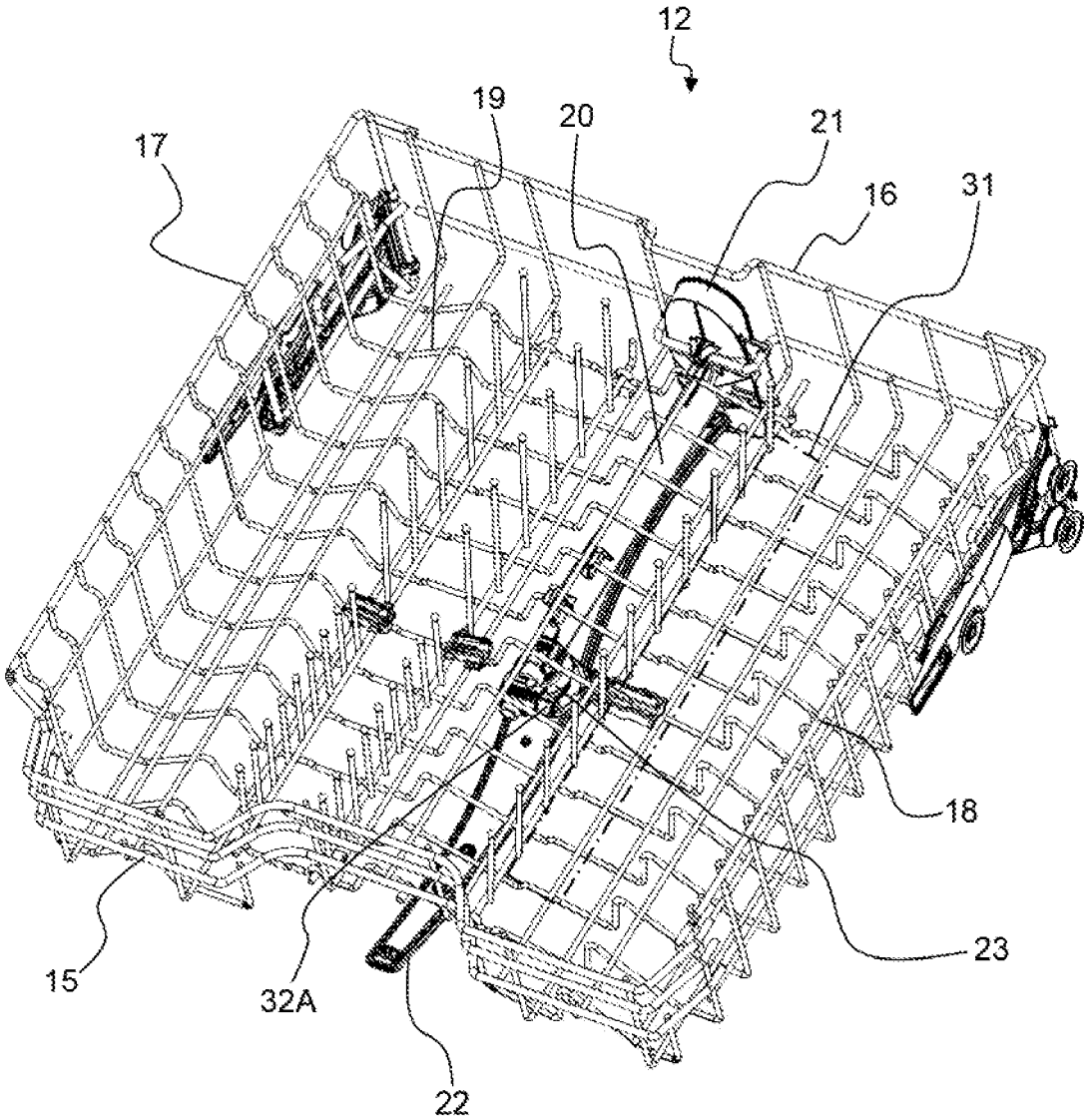
FIG. 2 shows a schematic perspective view of an embodiment of a dish-receiving unit for the household dishwasher according to FIG. 1.

FIG. 2 shows a schematic perspective view of an embodiment of a dish-receiving unit 12. The dish-receiving units 13, 14 may be configured similar to the dish-receiving unit 12. Hereinafter, however, details are provided only for the dish-receiving unit 12.

The dish-receiving unit 12 is of basket-shaped configuration and comprises a lattice-like front wall 15, which faces the closed door 3, a lattice-like rear wall 16 which is spaced apart from the front wall 15 and arranged parallel thereto and which faces the rear wall 9 of the dishwasher cavity 2, two lattice-like side walls 17, 18 which are arranged parallel to one another and spaced apart from one another as well as a lattice-like base 19. The front wall 15, the rear wall 16, the side walls 17, 18 and the base 19 are constructed from a plurality of wires connected together.

The dish-receiving unit 12 further comprises an inlet pipe 20 which is fixedly connected to the base 19 of the dish-receiving unit 12. For example, the inlet pipe 20 is clipped or snapped onto the base 19. The inlet pipe 20 is a plastic component. A coupling element 21 is provided on the inlet pipe 20, the inlet pipe 20 being able to be connected by said coupling element 21 to a supply pipe, not shown, of the household dishwasher 1 and detached again therefrom. When the dish-receiving unit 12 is displaced into the dishwasher cavity 2, the coupling element 21 is connected to the supply pipe. When the dish-receiving unit 12 is displaced out of the dishwasher cavity 2, the coupling element 21 is detached from the supply pipe. Via the supply pipe, washing liquor and/or fresh water may be supplied to the inlet pipe 20 by means of a circulating pump of the household dishwasher 1, not shown.

Moreover, the dish-receiving unit 12 has a spray arm 22 which is rotatably attached to the inlet pipe 20 at a bearing point 23. The spray arm 22 comprises a plurality of spray nozzles, items to be washed which are received in the dishwasher cavity 2 being able to be supplied thereby with washing liquor and/or fresh water. Moreover, an intensive washing zone 31 (shown by dashed dotted lines) is also connected to the inlet pipe 20. By means of the intensive washing zone 31 items to be washed which are heavily soiled and/or difficult to clean, such as for example bottles, may be particularly thoroughly cleaned.

The intensive washing zone 31 may optionally be switched by means of a manually operable on/off valve 32A from a deactivated state in which the intensive washing zone 31 is not supplied with washing liquor and/or fresh water, into an activated state in which the intensive washing zone 31 is supplied with washing liquor and/or fresh water, and vice versa. The on/off valve 32A is arranged between the inlet pipe 20 and the intensive washing zone 31 and is designed to connect fluidically the intensive washing zone 31 to the inlet pipe 20, and to disconnect the intensive washing zone 31 therefrom again. In the deactivated state of the intensive washing zone 31 the on/off valve 32A is closed and in the activated state of the intensive washing zone 31 the on/off valve 32A is open. The on/off valve 32A is arranged below the base 19 and may be operated through said base.

An "on/off valve" in the present case is to be understood as a valve which is either in a fully open or in a fully closed state. An intermediate state in such an on/off valve 32A is preferably not possible. The on/off valve 32A may also be denoted as a switching valve. The on/off valve 32A is manually operable. By "manually operable", it is to be understood in the present case that a user may operate the on/off valve 32A by hand, preferably with just one finger. An electronic actuating element, such as for example a solenoid valve or an electric motor, is preferably not provided.

Figure 3:
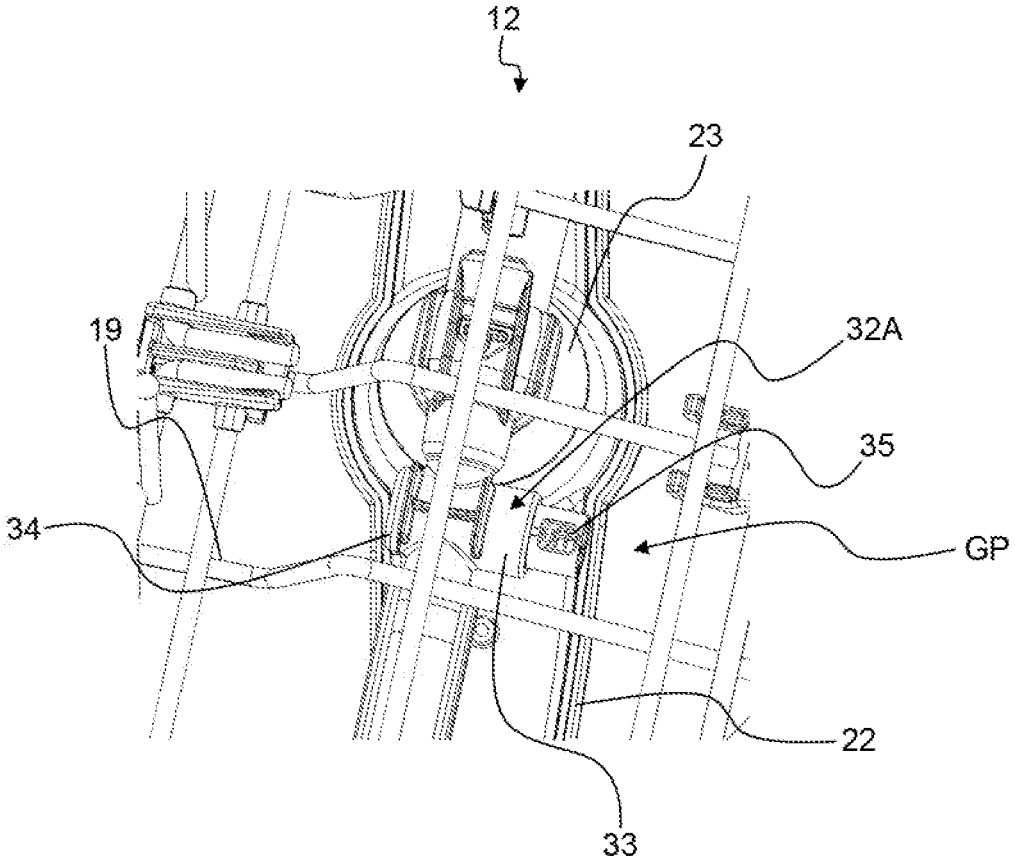
FIG. 3 shows a schematic perspective partial view of the dish-receiving unit according to FIG. 2.
Figure 4:
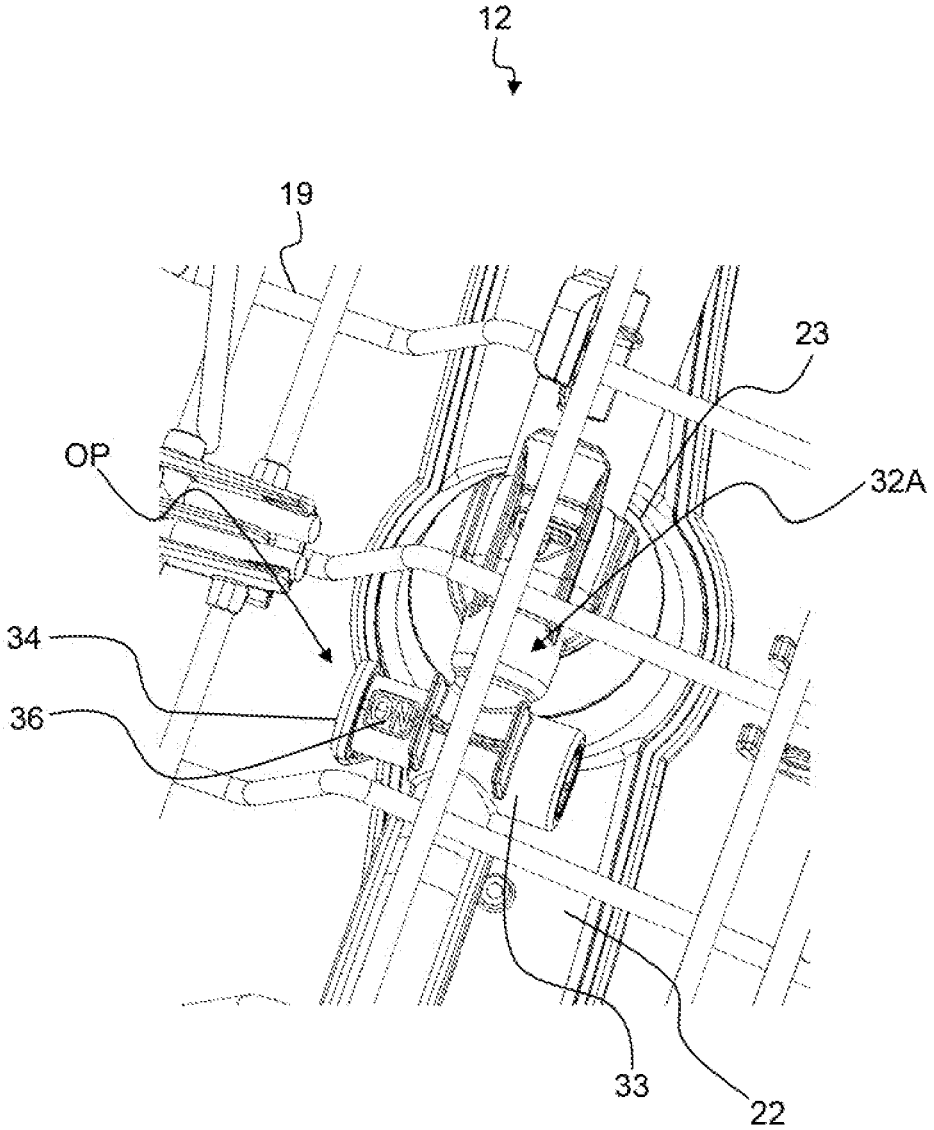
FIG. 4 shows a further schematic perspective partial view of the dish-receiving unit according to FIG. 2.

The on/off valve 32A may be switched from a closed position GP shown in FIG. 3 in which the on/off valve 32A is fully closed, into an open position OP shown in FIG. 4 in which the on/off valve 32A is fully open and vice versa.

The on/off valve 32A comprises a valve housing 33 and a valve body 34 received in the valve housing 33. The valve body 34 is displaceable in a linear manner in the valve housing 33. Thus the on/off valve 32A may also be denoted as a cross sliding valve. In this case, the valve body 34 may be operated through the base 19 of the dish-receiving unit 12 from above, preferably with just one finger. Two inscriptions 35, 36 are provided on the valve body 34. The inscription 35 indicates by "OFF" that the on/off valve 32A is in its closed position GP. The inscription 36 indicates by "ON" that the on/off valve 32A is in its open position OP. The valve body 34 and the valve housing 33 are preferably configured as plastic injection-molded components. The valve housing 33 is arranged between the inlet pipe 20 and the intensive washing zone 31.

Figure 5:
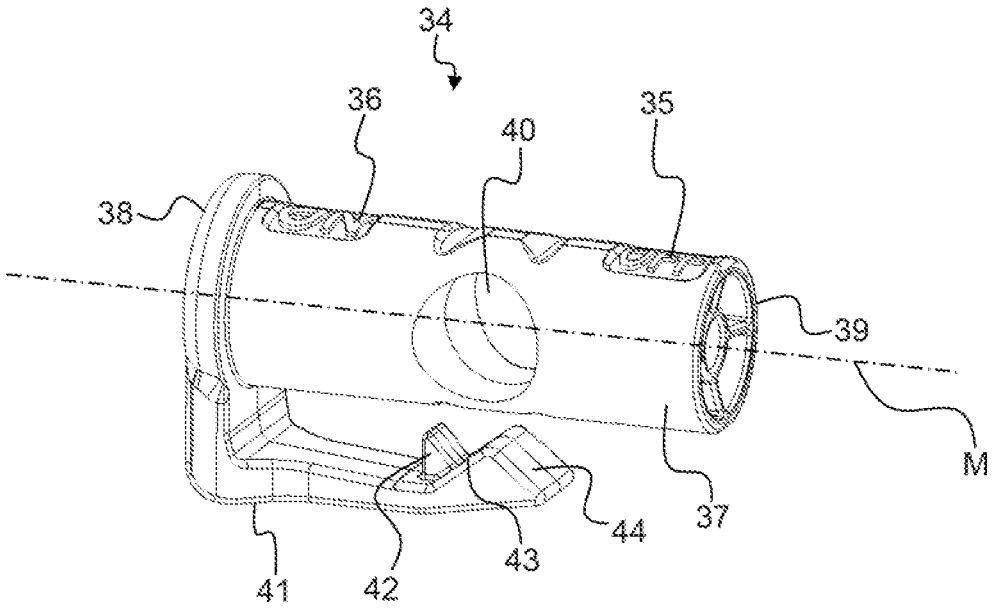
FIG. 5 shows a schematic perspective view of an embodiment of a valve body for an on/off valve for the dish-receiving unit according to FIG. 2.

FIG. 5 shows a preferred embodiment of the valve body 34 in a schematic perspective view. The valve body 34 comprises a barrel-shaped or cylinder-shaped base portion 37 with a first front side 38 and a second front side 39. The base portion 37 in this case is preferably constructed rotationally symmetrically to a central axis or axis of symmetry M. For switching the on/off valve 32A from the open position OP into the closed position GP, a compressive force is applied with a finger to the front side 38, and for switching the on/off valve 32A from the closed position GP into the open position OP a compressive force is applied with a finger to the front side 39.

The front side 38 in this case is of disk-shaped configuration and has a larger diameter than the base portion 37. Preferably a circular through-flow opening 40 is provided on the base portion 37. The through-flow opening 40 is oriented perpendicular to the axis of symmetry M. An L-shaped spring portion 41 extends out of the front side 38. The spring portion 41 is resiliently deformable. A stop 42 extending in the direction of the base portion 37 is provided on the spring portion 41. Furthermore, the spring portion 41 comprises two guiding surfaces 43, 44 which are inclined toward one another, in particular a first guiding surface 43 and a second guiding surface 44.

Figure 6:
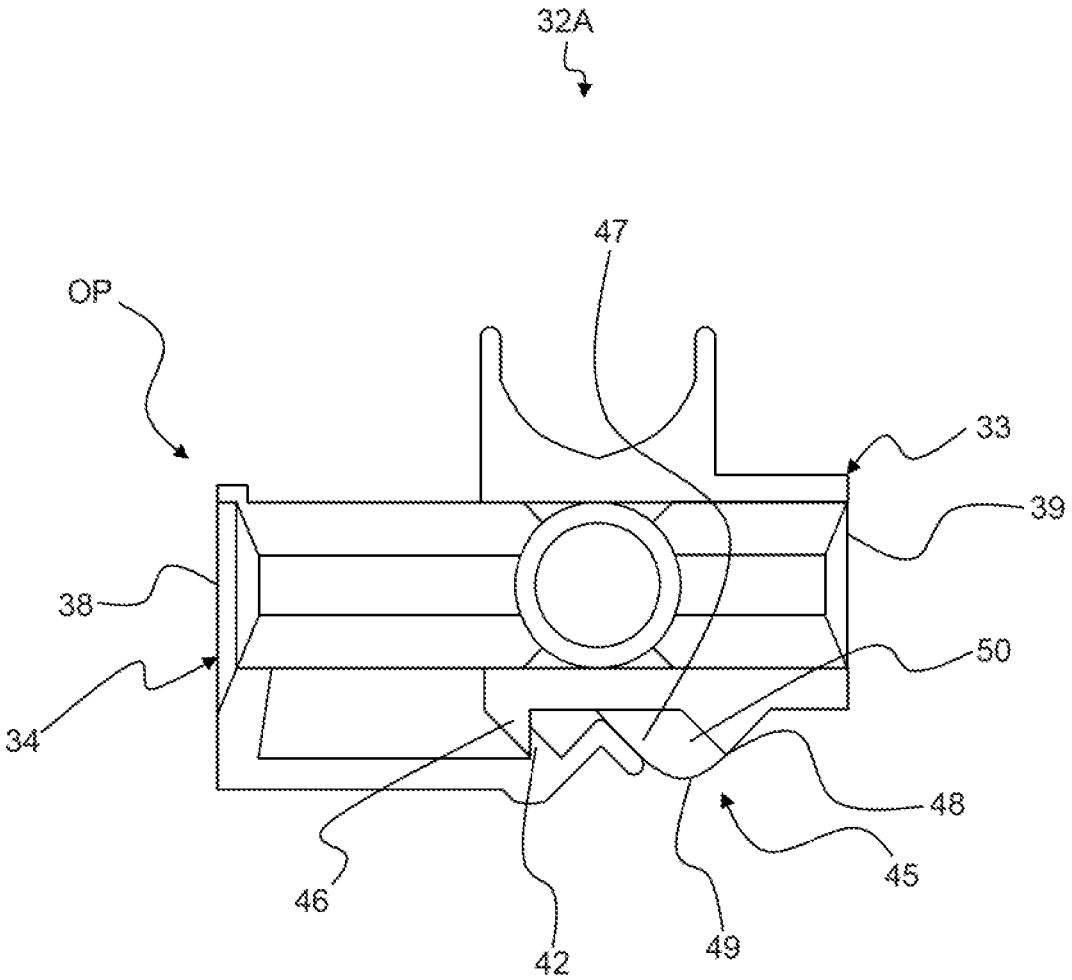
FIG. 6 shows a schematic sectional view of an embodiment of an on/off valve for the dish-receiving unit according to FIG. 2.
Figure 7:
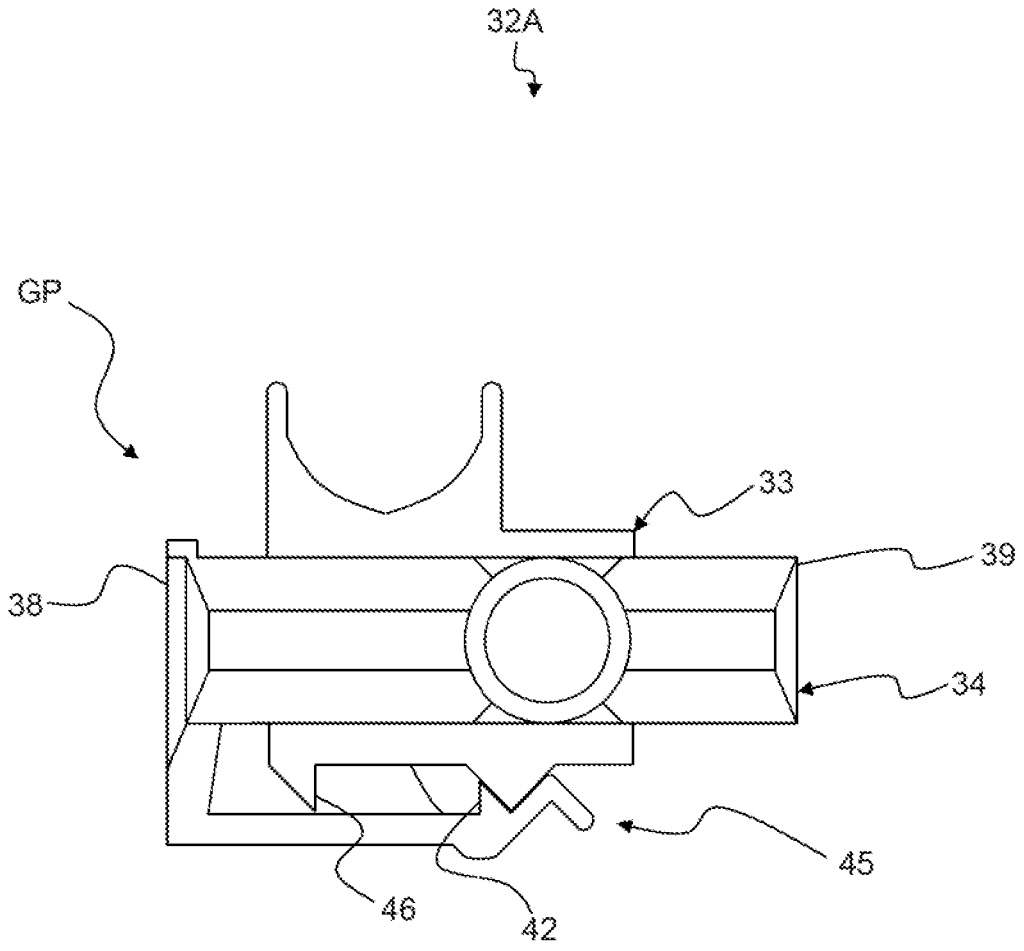
FIG. 7 shows a further schematic sectional view of the on/off valve according to FIG. 6.

As FIGS. 6 and 7 show, the valve housing 33 comprises a guiding portion 45 cooperating with the spring portion 41. The guiding portion 45 comprises an abutment 46 against which the stop 42 of the spring portion 41 in the open position OP of the on/off valve 32A bears (FIG. 6). Moreover, the guiding portion 45 comprises two mating surfaces 47, 48 which correspond to the guiding surfaces 43, 44 and which are inclined toward one another. In particular, a first mating surface 47 and a second mating surface 48 are provided. The mating surfaces 47, 48 transition into one another at an apex point 49 with a rounded shape. A recess 50 is also provided on the mating surface 47, the stop 42 of the spring portion 41 engaging therein in the closed position GP of the on/off valve 32A (FIG. 7).

In the open position OP of the on/off valve 32A, as mentioned above, the stop 42 bears against the abutment 46 and the guiding surface 44 bears against the mating surface 47. When a compressive force is applied to the front side 38, the guiding surface 44 then slides on the mating surface 47 and the spring portion 41 is deformed. As long as the guiding surface 44 has not yet slid over the apex point 49, and the compressive force is no longer applied from the front side 38, the valve body 34 snaps back automatically into the open position OP of the on/off valve 32A, shown in FIG. 6, due to the spring force of the spring portion 41. In other words, the on/off valve 32A is spring-biased in the direction of the open position OP and automatically switches back into the open position OP.

As soon as the guiding surface 44 is displaced past the apex point 49, the valve body 34 snaps automatically into the closed position GP of the on/off valve 32A, shown in FIG. 7, due to the spring force of the spring portion 41 and the compressive force applied by the user. In other words, the on/off valve 32A is also spring-biased in the direction of the closed position GP and is automatically switched into the closed position GP. In the closed position GP, the guiding surface 43 bears against the corresponding mating surface 48 thereof.

Moreover, the stop 42 comes to rest in the recess 50. By means of the recess 50 it is possible to prevent the stop 42 from sliding on the mating surface 47. Thus it is ensured that only the guiding surface 44 cooperates with the mating surface 47. In the open position OP the stop 42 bears against the abutment 46 and in the closed position GP the stop 42 is received in the recess 50. The stop 42 serves, therefore, as a travel limit and for the captive security of the valve body 34.

Figure 8:
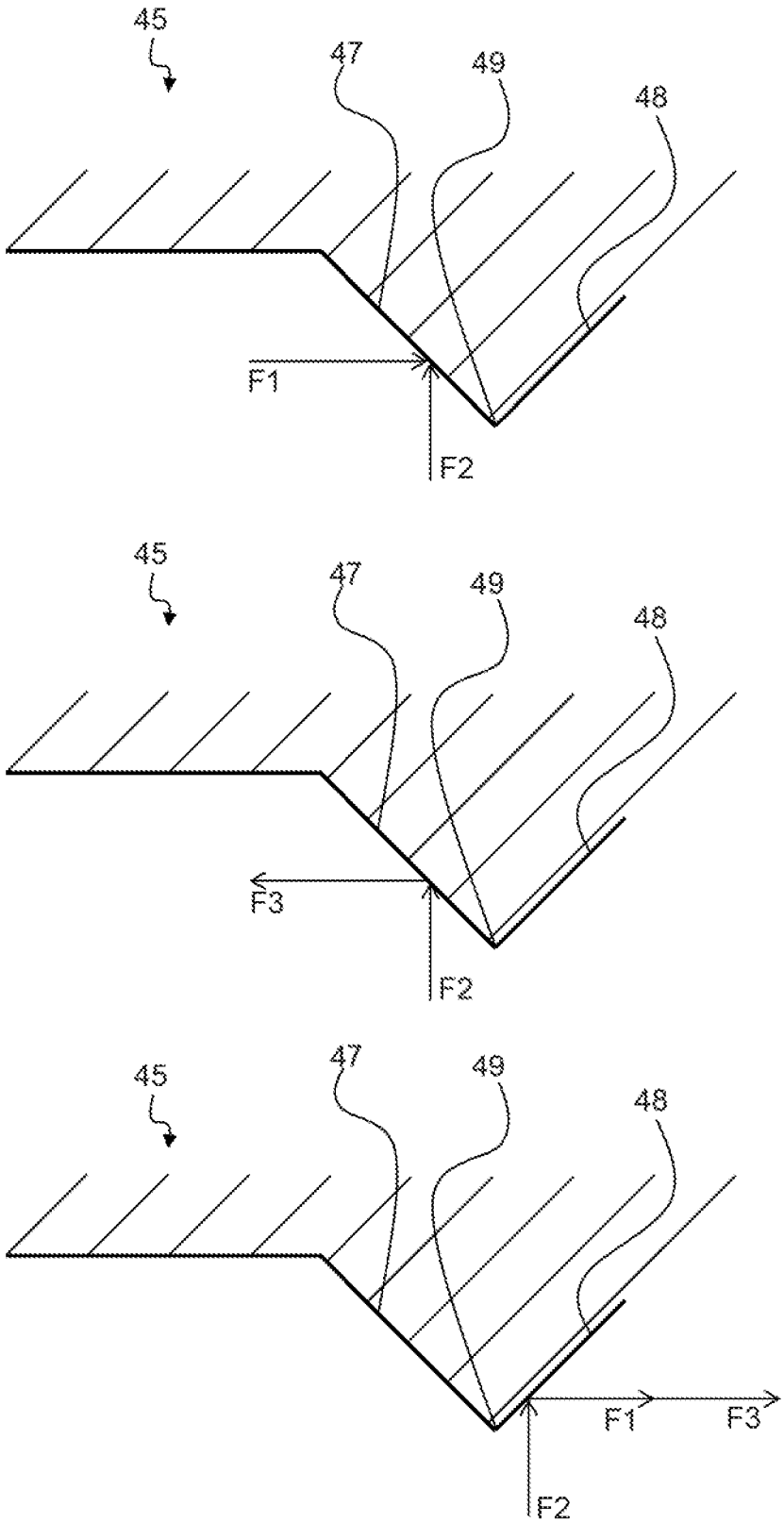
FIG. 8 shows schematically the functionality of the on/off valve according to FIG. 6.

FIG. 8 shows schematically the forces F1 to F3 acting when the on/off valve 32A is switched from the open position OP shown in FIG. 6 into the closed position GP shown in FIG. 7. Initially (FIG. 8 top) a force F1 is applied onto the front side 38, preferably with just one finger. The force F1 acts in this case parallel to the axis of symmetry M of the base portion 37. The force F1 is applied by means of the guiding surface 44 onto the mating surface 47. When the guiding surface 44 slides on the mating surface 47, the spring portion 41 is resiliently deformed and applies a force F2 acting perpendicular to the force F1 onto the mating surface 47. The force F2 in this case is oriented perpendicular to the axis of symmetry M.

As long as the apex point 49 has not yet been passed, and the force F1 is no longer applied to the front side 38 (FIG. 8 center), the force F2 applied by the spring portion 41 still acts on the mating surface 47. A force F3, resulting from the force F2 and oriented counter to the force F1, switches the on/off valve 32A back into the open position OP. As soon as the apex point 49 is passed (FIG. 8 bottom) the valve body 34 abruptly snaps into the closed position GP shown in FIG. 7, wherein the forces F1 and F3 are combined. When the on/off valve 32A is switched from the closed position GP shown in FIG. 7 into the open position OP shown in FIG. 6, the process is the same in principle but the opposite, as described above.

Figure 9:
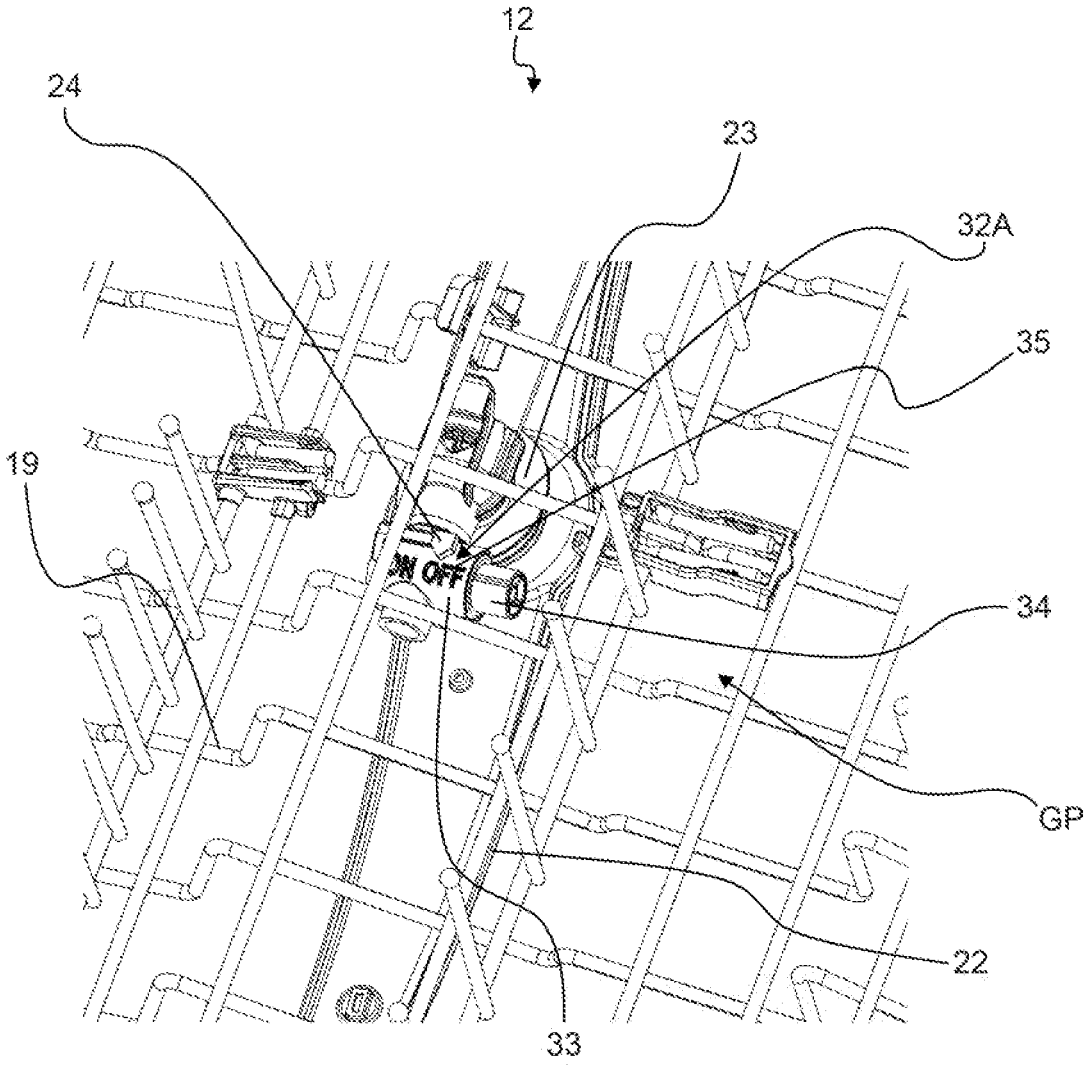
FIG. 9 shows a schematic perspective partial view of a further embodiment of a dish-receiving unit for the household dishwasher according to FIG. 1.
Figure 10:
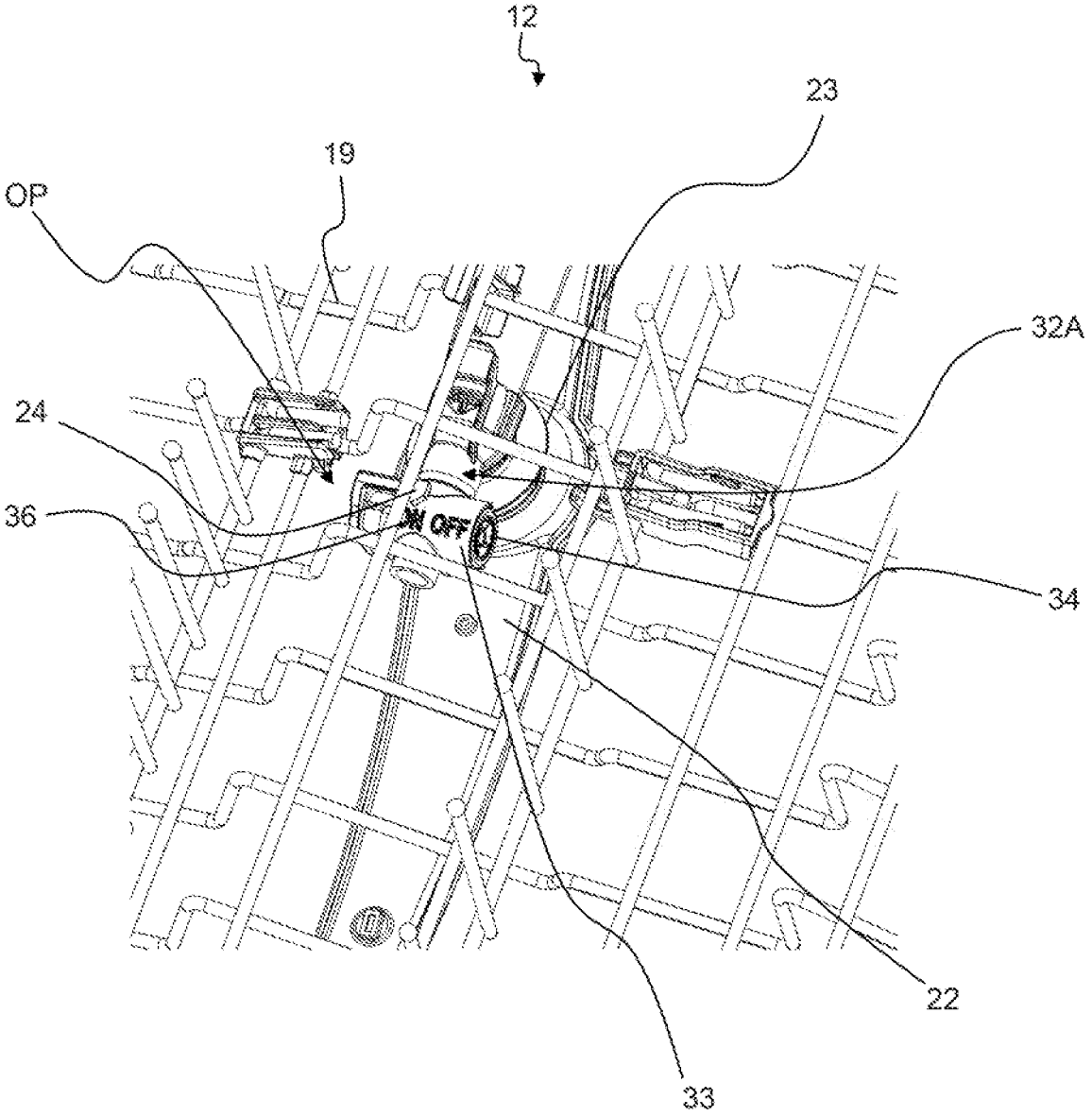
FIG. 10 shows a further schematic perspective partial view of the dish-receiving unit according to FIG. 9.

FIGS. 9 and 10 show a further embodiment of a dish-receiving unit 12. In this embodiment of the dish-receiving unit 12 the inscription 35, 36 of the on/off valve 32A, however, is not provided on the valve body 34 itself but on the valve housing 33. The valve body 34 comprises an arrow 24 which, according to whether the on/off valve 32A is in the closed position GP or in the open position OP, shows either the inscription 35 or the inscription 36.

Figure 11:
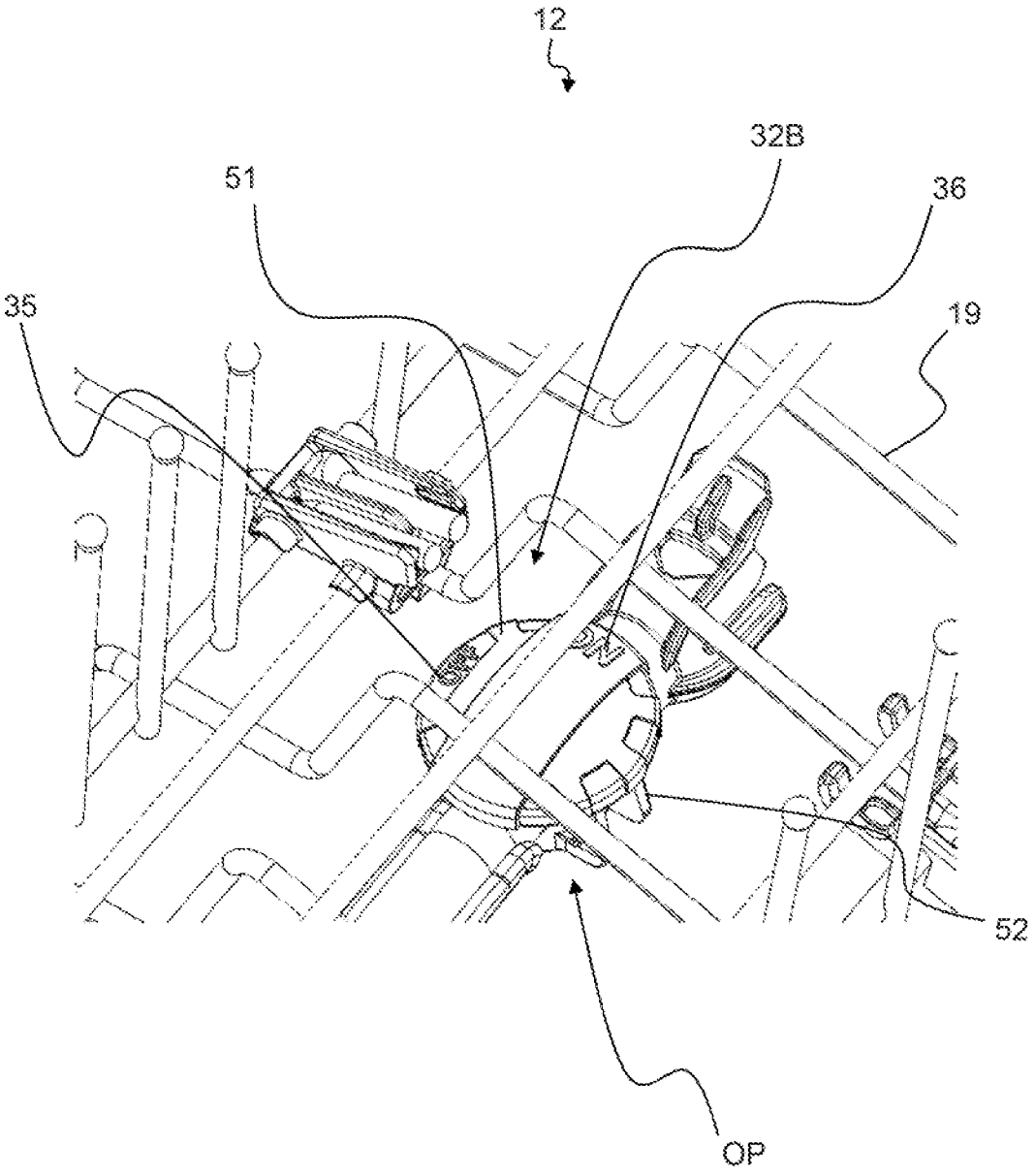
FIG. 11 shows a schematic perspective partial view of a further embodiment of a dish-receiving unit for the household dishwasher according to FIG. 1.
Figure 12:
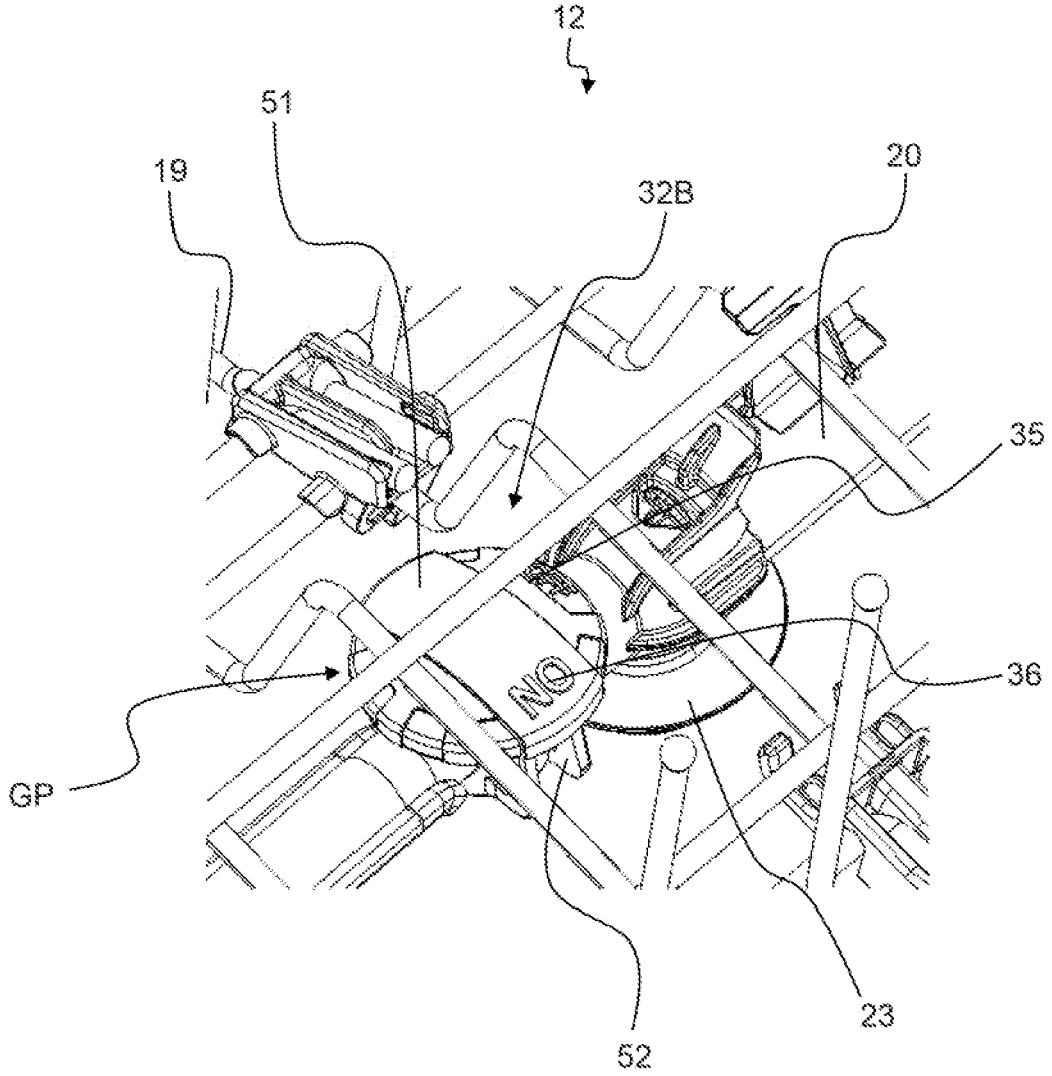
FIG. 12 shows a further schematic perspective partial view of the dish-receiving unit according to FIG. 11.

FIGS. 11 and 12 show a further embodiment of a dish-receiving unit 12. The dish-receiving unit 12 according to FIGS. 11 and 12 comprises an on/off valve 32B which in contrast to the on/off valve 32A described above is not configured as a cross sliding valve but as a rotary valve. Otherwise, the dish-receiving unit 12 according to FIGS. 11 and 12 corresponds to the dish-receiving unit described above according to FIGS. 2 to 4.

The on/off valve 32B comprises a valve body 51 with, as described above, the inscriptions 35, 36 and a valve housing 52 in which the valve body 51 is at least partially rotatably received. The valve body 51 and the valve housing 52 are preferably plastic injection-molded components. The on/off valve 32B may be switched from an open position OP shown in FIG. 11 into a closed position GP shown in FIG. 12 and vice versa. In this case the valve body 51 may be gripped by two fingers.

Figure 13:
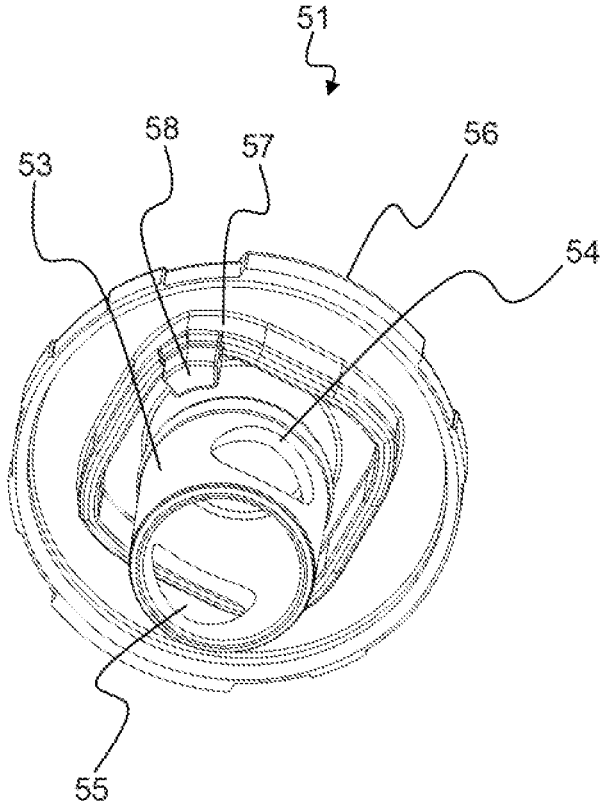
FIG. 13 shows a schematic perspective view of an embodiment of a valve body for an on/off valve for the dish-receiving unit according to FIG. 11.
Figure 14:
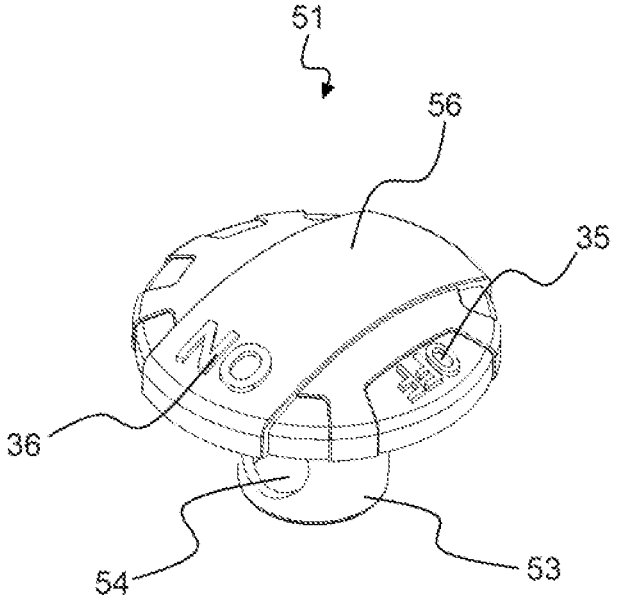
FIG. 14 shows a further schematic perspective view of the valve body according to FIG. 13.

The valve body 51 shown in FIGS. 13 and 14, in each case in a schematic perspective view, comprises a tubular base portion 53 with two opposing through-flow openings 54, 55. The base portion 53 extends out of the lower face of an operating portion 56 of the valve body 51. The operating portion 56 is umbrella-shaped. The inscriptions 35, 36 are provided on the operating portion 56. A square contour 57 with a stop 58 runs around the base portion 53.

Figure 15:
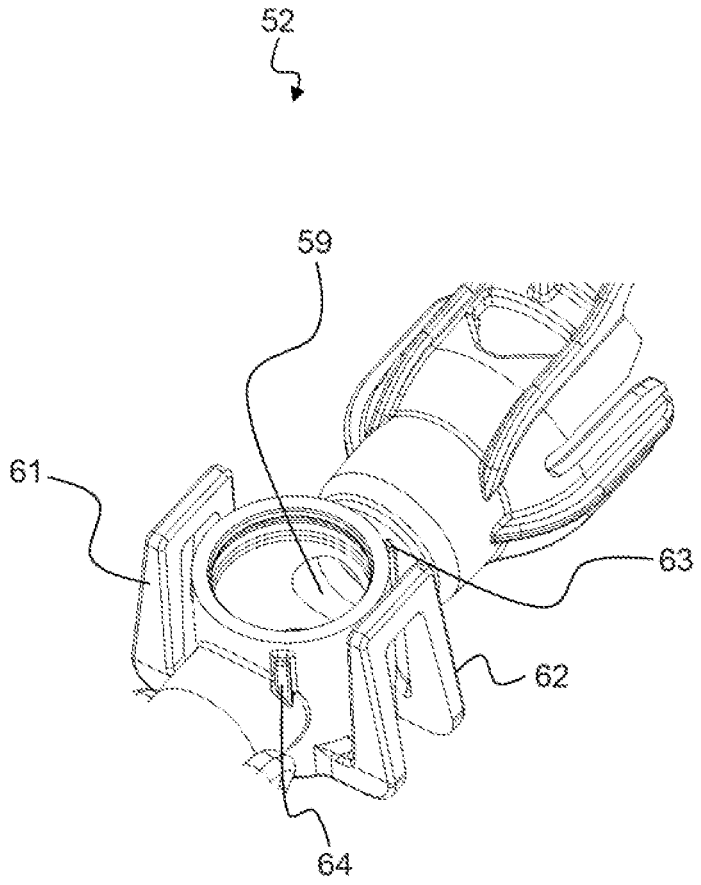
FIG. 15 shows a schematic perspective view of an embodiment of a valve housing for an on/off valve for the dish-receiving unit according to FIG. 11.
Figure 16:
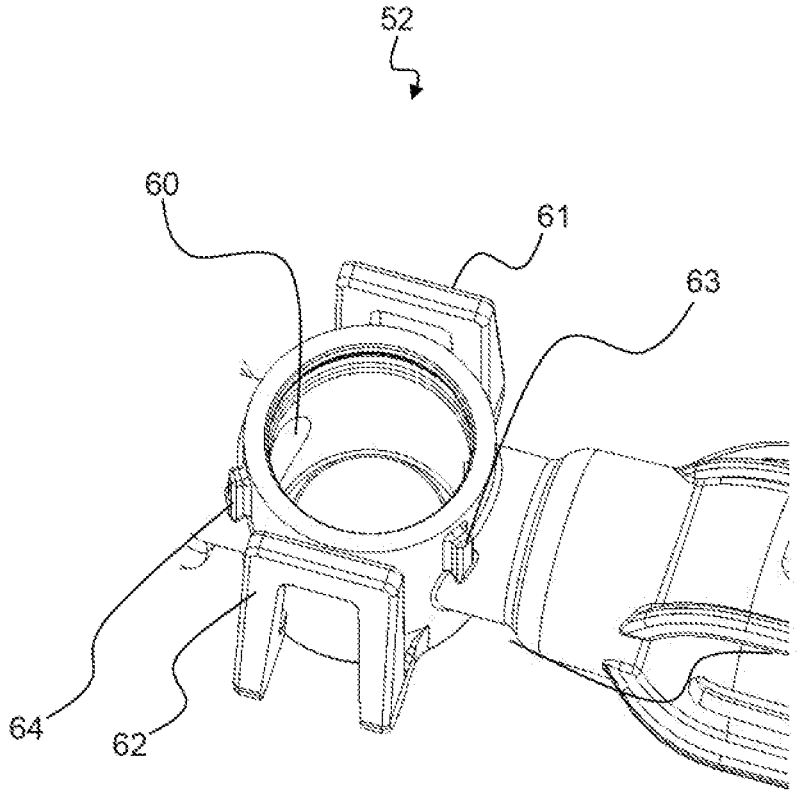
FIG. 16 shows a further schematic perspective view of the valve housing according to FIG. 15.

The valve housing 52, shown in each case in FIGS. 15 and 16 in a schematic perspective view, comprises through-flow openings 59, 60 corresponding to the through-flow openings 54, 55. In this case the through-flow opening 54 corresponds to the through-flow opening 59, and the through-flow opening 55 corresponds to the through-flow opening 60. Moreover, the valve housing 52 comprises two resiliently deformable spring portions 61, 62 which are able to cooperate with the square contour 57. Abutments 63, 64 corresponding to the stop 58 are also provided on the valve housing 52.

Figure 17:
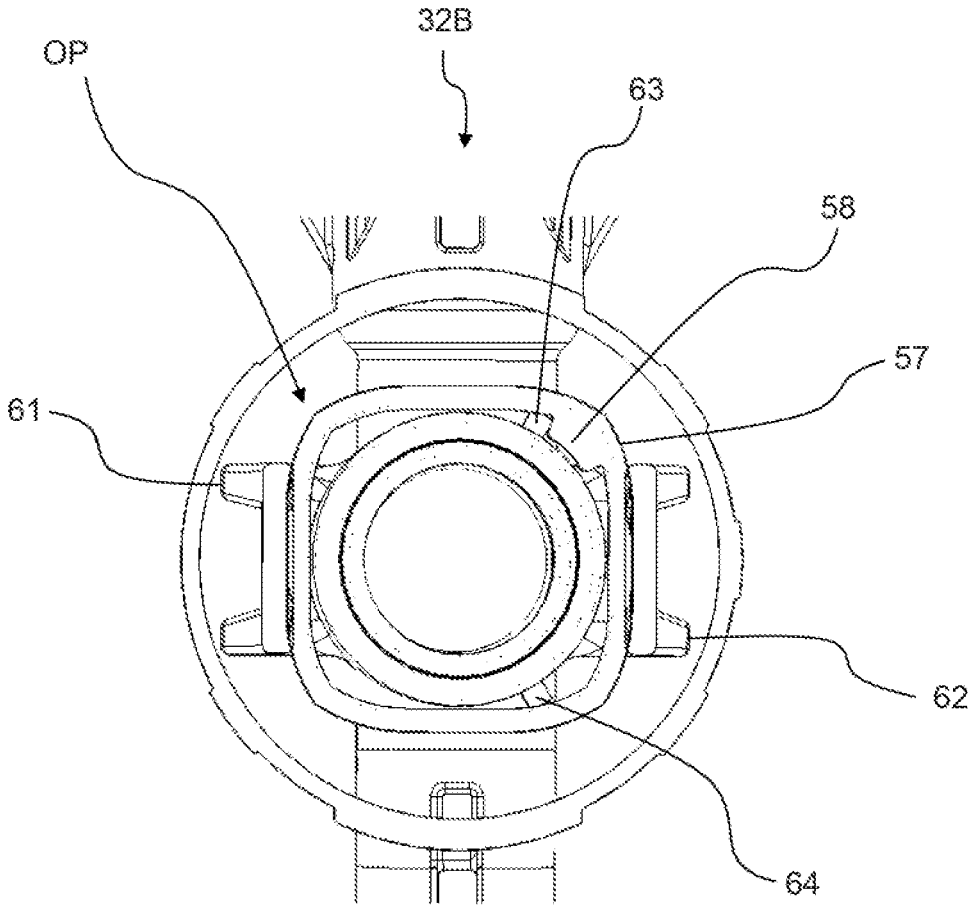
FIG. 17 shows a schematic sectional view of an embodiment of an on/off valve for the dish-receiving unit according to FIG. 11.
Figure 18:
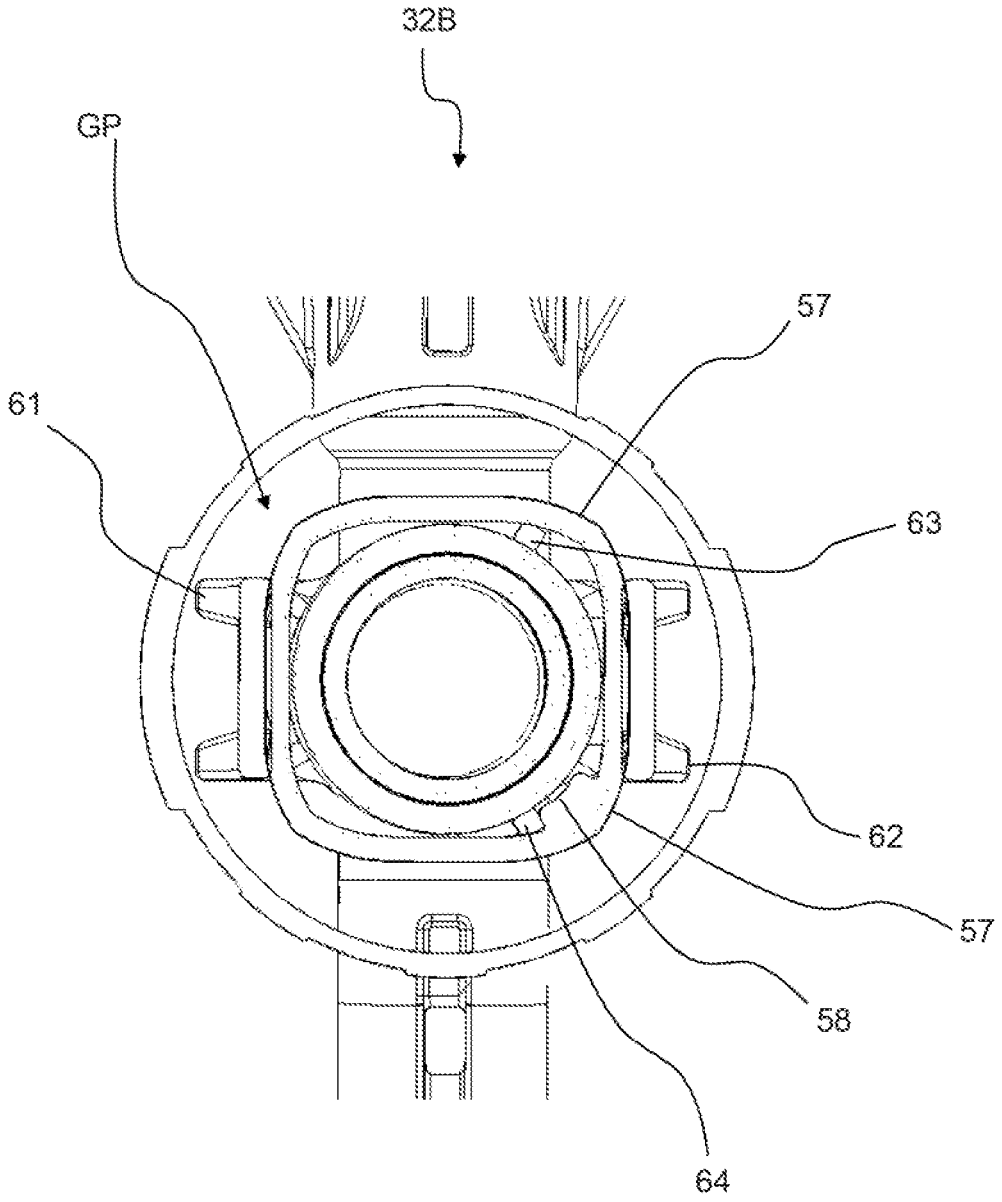
FIG. 18 shows a further schematic sectional view of the on/off valve according to FIG. 17.

For switching the on/off valve 32A from the open position OP (FIG. 17) into the closed position GP (FIG. 18) and vice versa, the valve body 51 is rotated by 90° relative to the valve housing 52. In particular, the valve body 51 is rotated clockwise by 90° for switching the on/off valve 32B from the open position OP into the closed position GP by applying an operating torque. Conversely, for switching the on/off valve 32B from the closed position GP into the open position OP the valve body 51 is rotated counterclockwise by 90° back in the direction of the open position OP by applying an operating torque.

Figure 19:
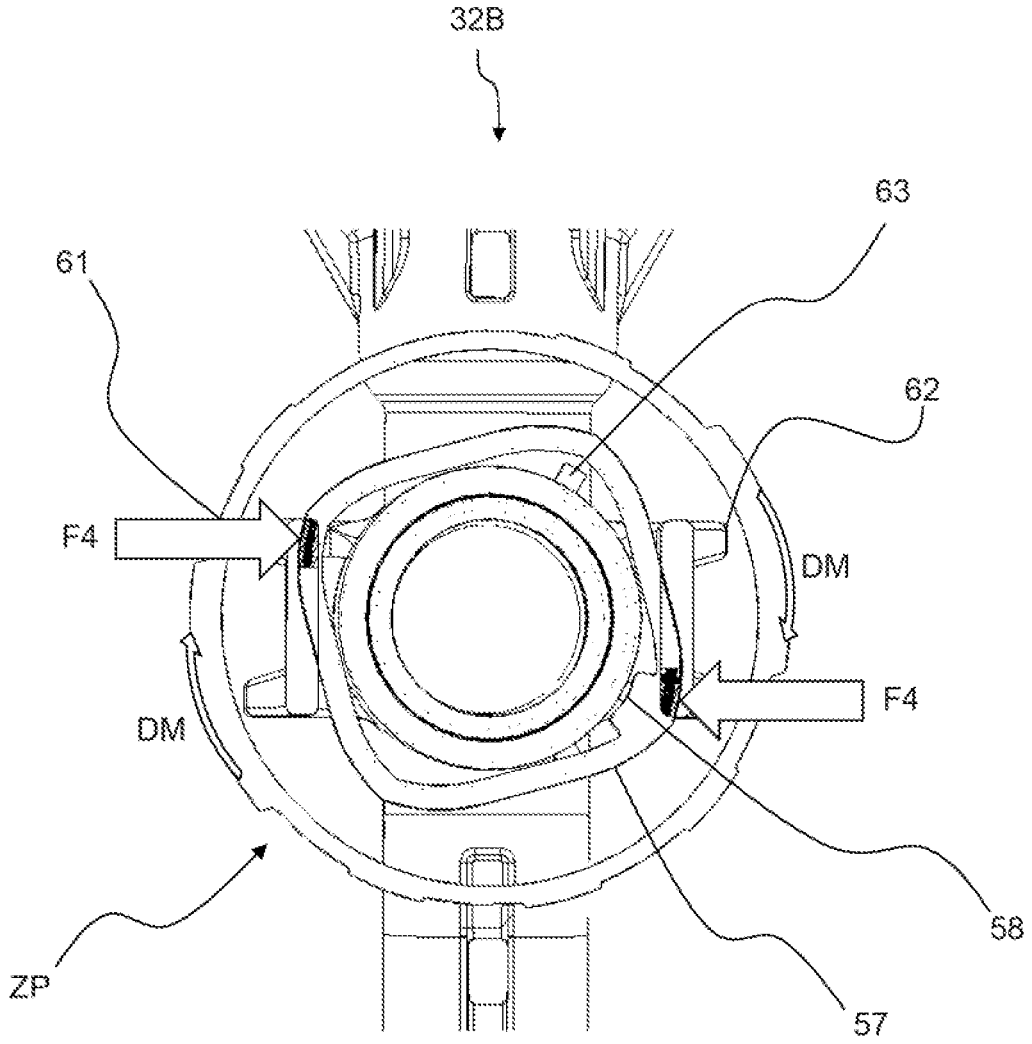
FIG. 19 shows a further schematic sectional view of the on/off valve according to FIG. 17.

Both when rotating the valve body 51 from the open position OP into the closed position GP and also vice versa, the spring portions 61, 62 provided on the valve housing 52 are deformed outwardly by means of the square contour 57. In this case, as shown in FIG. 19, a force F4, which in turn generates a torque DM which counteracts the operating torque applied by the user, acts on both sides on the square contour 57 located on the valve body 51. In this case, when the spring portions 61, 62 reach half the rotational travel at 45° they are subjected to the greatest possible deflection and thus generate the greatest possible force F4, but at the same time no torque DM.

The purpose of these spring portions 61, 62 and the torque DM, counteracting the operating torque of the customer and generated by the force F4, is that a valve intermediate state or intermediate position ZP is avoided. This is implemented by the valve body 51 being automatically switched into the open position OP or into the closed position GP, due to the spring-biasing of the spring portions 61, 62, if the user does not exactly set one of these positions manually. The square contour 57 is preferably not configured exactly as a square. The corners of the square contour 57 are partially rounded in order to prevent too great a deflection of the spring portions 61, 62 and thus a plastic deformation thereof. The stop 58 of the square contour 57 thus runs in the open position OP and in the closed position GP counter to the corresponding abutment 63, 64 of the valve housing 52.

The embodiments described above of the on/off valve 32A, 32B have a plurality of advantages. The on/off valve 32A, 32B is clearly visible to the user since the on/off valve 32A, 32B is attached below the dish-receiving unit 12. A simple controllability of the on/off valve 32A, with just one finger and the on/off valve 32B with several fingers, for example with two fingers, is possible. Due to the identification of the respective valve body 34, 51 and/or the valve housing 33 with the inscription 35, 36, an intuitive understanding of the switching state and the control logic is ensured. Due to its attachment below the base 19 of the dish-receiving unit 12 the on/off valve 32A, 32B is well protected from damage by items to be washed. Even in the case of a fully loaded dish-receiving unit 12, a subsequent operation of the on/off valve 32A, 32B from below or from the side is possible.

The on/off valve 32A, 32B is able to be embodied using a separate additional component, which may be already premounted on the intensive washing zone 31. A complex additional mounting of switching parts, switching rods, electronic switching valves or the like is not required on the dish-receiving unit 12. Only small flow losses are produced since the on/off valve 32A, 32B is integrated directly in the water supply of the intensive washing zone 31. This results in a very small spray shadow by the spray arm 22 due to the small installation space of the on/off valve 32A, 32B. Due to the presence of the respective spring portions 41, 61, 62, undesired intermediate positions ZP of the on/off valve 32A, 32B are reliably prevented. This results in high quality haptic characteristics of the on/off valve 32A, 32B, due to the on/off valve 32A, 32B being snapped both into the open position OP and into the closed position GP.

Whilst the present invention has been described with reference to exemplary embodiments, it may be modified in various ways.

The invention claimed is:

1. A dish-receiving unit for a household dishwasher, said dish-receiving unit comprising:

a lattice-like base;

an inlet pipe;

an intensive washing zone; and a manually operable on/off valve comprising an open position and a closed position, the manually operable on/off valve arranged (i) between the inlet pipe and the intensive washing zone, and (ii) below and exterior from the lattice-like base of the dish-receiving unit when the manually operable on/off valve is in the open position, in the closed position, and when the manually operable on/off valve is being switched from the open position to the closed position and vice versa, the manually operable on/off valve configured to switch the intensive washing zone optionally from a deactivated state to an activated state and vice versa, said on/off valve being operable through the lattice-like base, wherein the on/off valve includes a valve housing and a valve body received in the valve housing, the valve body having a spring portion configured to spring-bias the valve body both in the direction of the open position and in the direction of the closed position.

2. The dish-receiving unit of claim 1, constructed in the form of a dish rack.

3. The dish-receiving unit of claim 1, wherein the on/off valve is embodied as a cross sliding valve.

4. The dish-receiving unit of claim 1, wherein the valve body is displaceable in a linear manner in the valve housing for switching the on/off valve from an open position into a closed position and vice versa.

5. The dish-receiving unit of claim 1, wherein the spring portion has a guiding surface which, when the on/off valve is switched from the open position into the closed position and vice versa, slides on a corresponding mating surface of the valve housing until an apex point of the mating surface is reached, said spring portion automatically switching the on/off valve into the closed position or into the open position when the apex point is passed.

6. The dish-receiving unit of claim 5, wherein the guiding surface of the spring portion has a first guiding surface and a second guiding surface which are inclined relative to one another.

7. The dish-receiving unit of claim 5, wherein the mating surface of the valve housing has a first mating surface and a second mating surface which are inclined relative to one another, said first mating surface transitioning into the second mating surface at the apex point.

8. The dish-receiving unit of claim 1, wherein the spring portion includes a stop which in the open position bears against a corresponding abutment of the valve housing.

9. The dish-receiving unit of claim 8, wherein the spring portion has a guiding surface which, when the on/off valve is switched from the open position into the closed position and vice versa, slides on a corresponding mating surface of the valve housing until an apex point of the mating surface is reached, said stop engaging in a recess of the mating surface of the valve housing in the closed position of the on/off valve.

10. The dish-receiving unit of claim 1, wherein the on/off valve is embodied as a rotary valve.

11. The dish-receiving unit of claim 1, wherein the on/off valve includes a valve housing and a valve body received in the valve housing and rotatable in the valve housing for switching the on/off valve from an open position into a closed position and vice versa.

12. The dish-receiving unit of claim 11, wherein the valve housing includes spring portions configured to spring-bias the valve body both in a direction of the open position and in a direction of the closed position.

13. The dish-receiving unit of claim 12, wherein the valve body has a square contour configured to deform the spring portions in a resilient manner when the on/off valve is switched from the open position into the closed position and vice versa.

14. A household dishwasher, comprising a dish-receiving unit, said dish-receiving unit comprising a lattice-like base, an inlet pipe, an intensive washing zone, and a manually operable on/off valve comprising an open position and a closed position, the manually operable on/off valve arranged (i) between the inlet pipe and the intensive washing zone, and (ii) below and exterior to the lattice-like base of the dish-receiving unit when the manually operable on/off valve is in the open position, in the closed position, or when the manually operable on/off valve is switched from the open position to the closed position and vice versa, the manually operable on/off valve configured to switch the intensive washing zone optionally from a deactivated state to an activated state and vice versa, said on/off valve being operable through the lattice-like base, wherein the on/off valve includes a valve housing and a valve body received in the valve housing, the valve body having a spring portion configured to spring-bias the valve body in the direction of the open position and in the direction of the closed position.

15. The household dishwasher of claim 14, wherein the on/off valve is embodied as a cross sliding valve.

16. The household dishwasher of claim 14, wherein the valve body is displaceable in a linear manner in the valve housing for switching the on/off valve from an open position into a closed position and vice versa.

17. The household dishwasher of claim 14, wherein the spring portion has a guiding surface which, when the on/off valve is switched from the open position into the closed position and vice versa, slides on a corresponding mating surface of the valve housing until an apex point of the mating surface is reached, said spring portion automatically switching the on/off valve into the closed position or into the open position when the apex point is passed.

18. The household dishwasher of claim 17, wherein the guiding surface of the spring portion has a first guiding surface and a second guiding surface which are inclined relative to one another.

19. The household dishwasher of claim 17, wherein the mating surface of the valve housing has a first mating surface and a second mating surface which are inclined relative to one another, said first mating surface transitioning into the second mating surface at the apex point.

20. The household dishwasher of claim 14, wherein the spring portion includes a stop which in the open position bears against a corresponding abutment of the valve housing.

21. The household dishwasher of claim 20, wherein the spring portion has a guiding surface which, when the on/off valve is switched from the open position into the closed position and vice versa, slides on a corresponding mating surface of the valve housing until an apex point of the mating surface is reached, said stop engaging in a recess of the mating surface of the valve housing in the closed position of the on/off valve.

22. The household dishwasher of claim 14, wherein the on/off valve is embodied as a rotary valve.

23. The household dishwasher of claim 14, wherein the on/off valve includes a valve housing and a valve body received in the valve housing and rotatable in the valve housing for switching the on/off valve from an open position into a closed position and vice versa.

24. The household dishwasher of claim 23, wherein the valve housing includes spring portions configured to spring-bias the valve body both in a direction of the open position and in a direction of the closed position.

25. The household dishwasher of claim 24, wherein the valve body has a square contour configured to deform the spring portions in a resilient manner when the on/off valve is switched from the open position into the closed position and vice versa.

* * * * *